US011296399B2

(12) United States Patent
Hung et al.

(10) Patent No.: US 11,296,399 B2
(45) Date of Patent: Apr. 5, 2022

(54) ANTENNAS IN THIN DEVICES

(71) Applicant: HEWLETT-PACKARD DEVELOPMENT COMPANY, L.P., Spring, TX (US)

(72) Inventors: Kuan-Jung Hung, Taipei (TW); Chih-Hung Chien, Taipei (TW); Min-Hsu Chuang, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 159 days.

(21) Appl. No.: 16/481,498

(22) PCT Filed: Jul. 13, 2017

(86) PCT No.: PCT/US2017/041928
§ 371 (c)(1),
(2) Date: Jul. 29, 2019

(87) PCT Pub. No.: WO2019/013803
PCT Pub. Date: Jan. 17, 2019

(65) Prior Publication Data

US 2021/0280958 A1 Sep. 9, 2021

(51) Int. Cl.
*H01Q 21/28* (2006.01)
*H01Q 1/22* (2006.01)
*H01Q 21/30* (2006.01)

(52) U.S. Cl.
CPC ..... *H01Q 1/2266* (2013.01); *H01Q 21/28* (2013.01); *H01Q 21/30* (2013.01); *H01Q 1/2283* (2013.01)

(58) Field of Classification Search
CPC ..... H01G 1/2266; H01G 21/28; H01G 21/30; H01G 1/2283
See application file for complete search history.

(56) References Cited

U.S. PATENT DOCUMENTS 8,325,096 B2 12/2012 Vazquez et al.
8,482,469 B2 7/2013 Ayala et al.
9,450,289 B2 9/2016 Guterman et al.
(Continued)

FOREIGN PATENT DOCUMENTS

CN 101083348 12/2007
CN 101101500 1/2008
(Continued)

OTHER PUBLICATIONS

Chang, S et al., A Compact 3D Antenna with Comprehensive LTE Band Coverage for Use on Notebook Hinge, Aug. 2012 https://www.researchgate.net/publication/261112226_A_compact_3.
(Continued)

*Primary Examiner* — Graham P Smith
(74) *Attorney, Agent, or Firm* — HPI Patent Department

(57) ABSTRACT

A computer device including integrated communications antennas is disclosed. In the computer device, a first antenna is disposed above a display panel in a hinge-up portion of the laptop computer, and a second antenna is disposed below the display panel. A signal divider circuit is coupled to a radio module, wherein the signal divider circuit is configured to send a first frequency range to the first antenna via a flat printed circuit radio frequency (FPC RF) cable, and a second frequency range to the second antenna.

20 Claims, 5 Drawing Sheets

(56) References Cited

U.S. PATENT DOCUMENTS

| | | | | |
|---|---|---|---|---|
| 9,680,202 | B2 | 6/2017 | Irci et al. | |
| 2003/0030586 | A1 | 2/2003 | Suzuki et al. | |
| 2008/0111746 | A1* | 5/2008 | Levy | H01Q 21/28 343/702 |
| 2010/0321255 | A1 | 12/2010 | Kough et al. | |
| 2012/0074988 | A1 | 3/2012 | Lashkari et al. | |
| 2014/0307380 | A1 | 10/2014 | Nakamura et al. | |
| 2015/0255851 | A1 | 9/2015 | Guterman et al. | |
| 2017/0192478 | A1* | 7/2017 | Mercer | H04B 1/3838 |

FOREIGN PATENT DOCUMENTS

| | | | |
|---|---|---|---|
| CN | 103594793 | A | 2/2014 |
| CN | 105811123 | | 7/2016 |
| GB | 2404791 | A | 2/2005 |
| JP | 2003264410 | A | 9/2003 |
| TW | 200950363 | | 12/2009 |
| TW | 542913 | | 6/2017 |

OTHER PUBLICATIONS

Wei Wang et al: "A design of diplexer with high isolation and out-of-band rejection", 2015 IEEE 6th international symposium on microwave, antenna, propagation, and EMC technologies (MAPE), IEEE, Oct. 28, 2015 (Oct. 28, 2015), pp. 696-699, XP03292338.

* cited by examiner

100

200

300

400

ANTENNAS IN THIN DEVICES

BACKGROUND

Laptop computers are designed to place components in optimum locations. For example, antennas placed above the top of a display panel, in the upper case, or hinge-up portion, may provide the best communication signals. These antennas may be connected to circuitry through a coaxial cable leading from the lower case, behind the display panel. However, laptops are being developed and sold that have very thin hinge-up portions. As the hinge-up portion has become progressively thinner, the coaxial cables are too thick to be used behind the display panel.

DESCRIPTION OF THE DRAWINGS

Certain examples are described in the following detailed description and in reference to the drawings, in which.

DETAILED DESCRIPTION

Examples described herein provide computing devices, herein also termed computer devices, that have integrated antennas for radio communications. The antennas may cover frequency bands for wireless local area network (WLAN) communications, and wireless wide area network (WWAN) communications, among others. The computing devices may include personal computers, laptop computers, tablet computers, all-in-one computers, or smart phones, among others. In many systems, the antennas may be located below a display panel, for example, in a lower region of a hinge-up portion of a laptop. However, there is limited space for multiple antennas below the display in the hinge-up portion. Further, the use of multiple antennas in this location may lead to isolation issues between the antennas.

In examples described herein, the antennas are located both above and below a display panel to allow multiple antennas while minimizing crosstalk and other interference. The antennas may be connected to transceiver circuitry through coaxial cables. However, as portions of the computing device, such as a hinge-up portion holding the display in a laptop computer, become thinner, the space behind the display becomes too limited to use a coaxial cable. For example, when the gap between a cover and a display panel is less than about 0.3 mm, an RF coaxial cable of 0.64 millimeter (mm) outer diameter (O.D.) is too large to fit behind the display panel.

A flat printed circuit cable (FPC) capable of carrying radio frequencies (RF) may be used, but may cause significant signal losses at higher frequencies. To get around this problem, examples described herein place a lower frequency antenna above the display and a higher frequency antenna below the display. A signal splitter, such as a series of bandpass filters, or an impedance matching circuit, is used to divide a single signal from a transceiver circuit, sending the lower frequency signals through an FPC RF cable to an antenna above the display, while sending the higher frequency signals to an antenna below the display.

Figure 1:
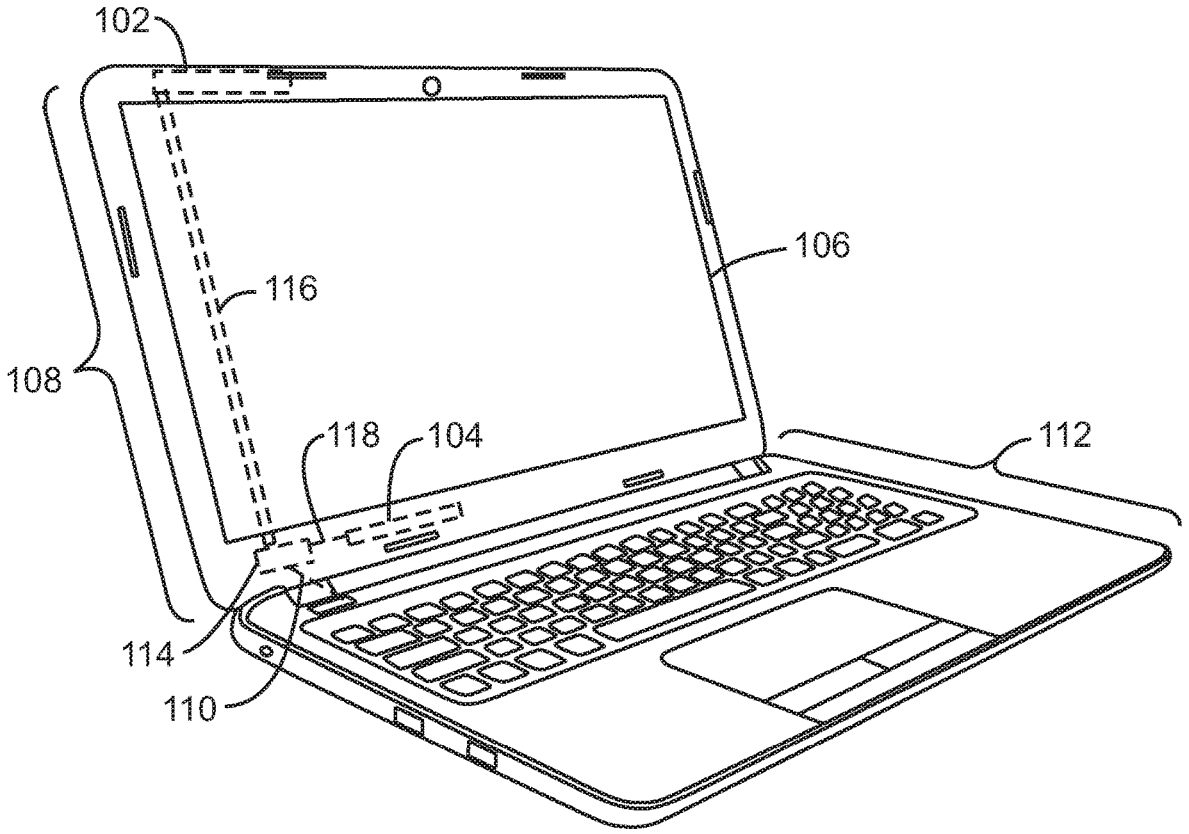
FIG. 1 is a drawing of an example of a computing device with communications antennas positioned above and below a display panel in a hinge-up portion of the computing device.

FIG. 1 is a drawing of an example of a computing device 100 with communications antennas 102 and 104 positioned above and below a display panel 106 in a hinge-up portion 108 of the computing device 100. A coaxial cable 110, for example, feeding through a hinge from the circuit board in the lower portion 112 of the computing device 100 may couple a transceiver in the lower portion 112 to a splitting circuit 114 in the hinge-up portion 108. The two antennas 102 and 104 may form an antenna structure for dual band communications.

The splitting circuit 114 may be coupled to a first antenna 102, above the display, through an FPC RF cable 116. A second antenna 104 may be coupled to the splitting circuit 114 either by a coaxial cable 118 or by a short FPC RF cable. Signal losses in a short FPC RF cable may be acceptable for the application.

For laptop computers having a 13-inch display, the FPC RF cable 116 may be about 200 mm, or longer. Compared to a 0.64 mm O.D. coaxial cable of the same length, it will cause an additional insertion loss of about 1.0 dB in the range of about 699 megahertz (MHz) to about 2170 MHz, about 1.0 to 1.5 dB in the range of about 2300 MHz to about 2690 MHz, about 1.5 dB in the range of about 3400 MHz to about 3800 MHz, and about 3.0 dB in the range of 5150 MHz to about 5850 MHz. These frequency ranges correspond to the frequency bands shown in Table 1, below.

TABLE 1

Frequency Ranges for Frequency Bands

| Band Category | Bands | Frequency Range (MHz) |
|---|---|---|
| LB | B5, B6, B12, B13, B14, B17, B18, B19, B20, B26, B27, B28, B29 | 690-960 |
| MB | B1, B2, B3, B4, B9, B10, B23, B25, B33, B34, 36, B37, B39, B66 | 1700-2200 |
| HB | B7, B30, B38, B40, B41 | 2300-2690 |
| UHB | B42, B43 | 3400-3800 |
| LAA/LTE-U | LTE B252, B255, B46 | 5150-5925 |

The splitting circuit 114 may include a combination of a low bandpass filter to send the low frequency signals to the first antenna 102 and a high bandpass filter to send the high-frequency signals to the second antenna 104. As used herein, low frequency signals are signals with a frequency of less than about 3000 MHz, such as the LB, MB, and HB bands, and high-frequency signals are signals with a frequency of greater than about 3000 MHz, such as the UHB and LAA/LTE-U bands.

In some examples, the splitting circuit 114 may be an impedance matching circuit. An impedance matching circuit may have a lower insertion loss than the bandpass filters. One example of an impedance matching circuit that may be used is the 0805 WLAN Dieplexer, available from AVX Corporation of Fountain Inn, S.C., USA. Other commercially available impedance matching circuits may be used.

Figure 2:
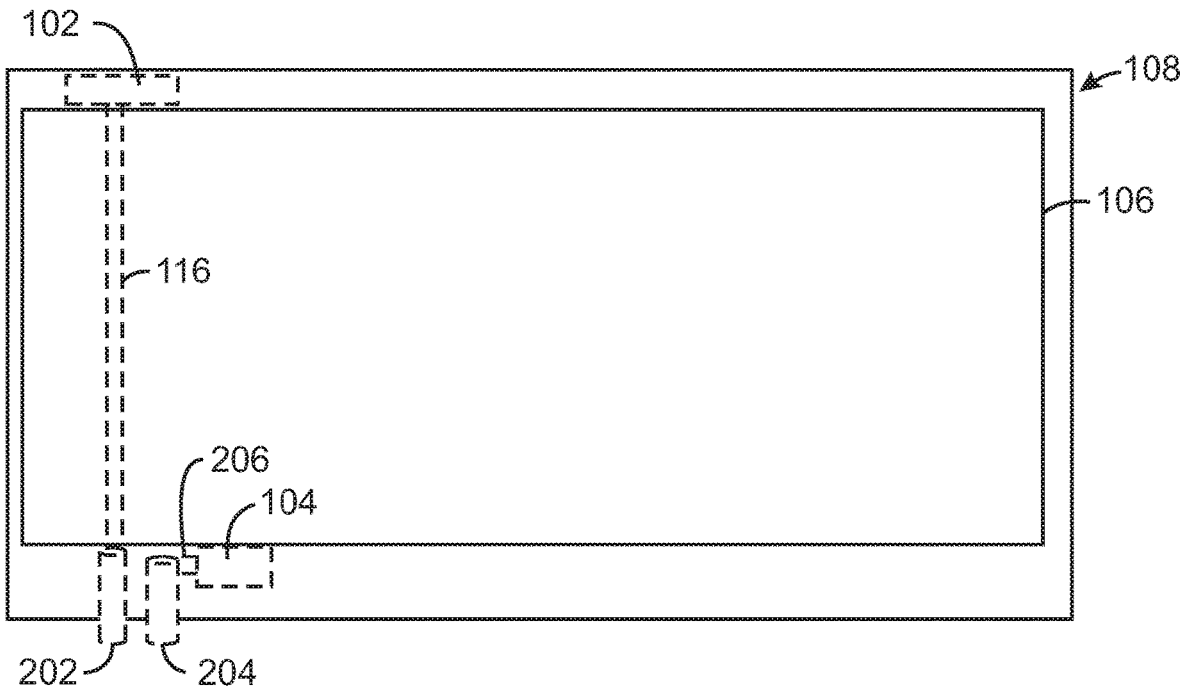
FIG. 2 is a drawing of an example of a hinge-up portion of a computing device showing an example of separate feeds to different antennas.

FIG. 2 is a drawing of an example of a hinge-up portion 108 of a computing device 200 showing an example of separate feeds to different antennas 102 and 104. Like numbered items are as described with respect to FIG. 1. In this example, no splitting circuit is used. A coaxial cable 202 from a transceiver circuit in the computing device 200 is coupled to the FPC RF cable 116 to carry the low-frequency signals to the first antenna 102. A second coaxial cable 204 from a transceiver circuit in the computing device 200 carries the high-frequency signals to the second antenna 104. The second coaxial cable 204 may be directly coupled to the second antenna 104, or may be coupled by a short segment of coaxial cable 206. In some examples, the short segment of coaxial cable 206 may be replaced by a short FPC RF cable.

Figure 3:
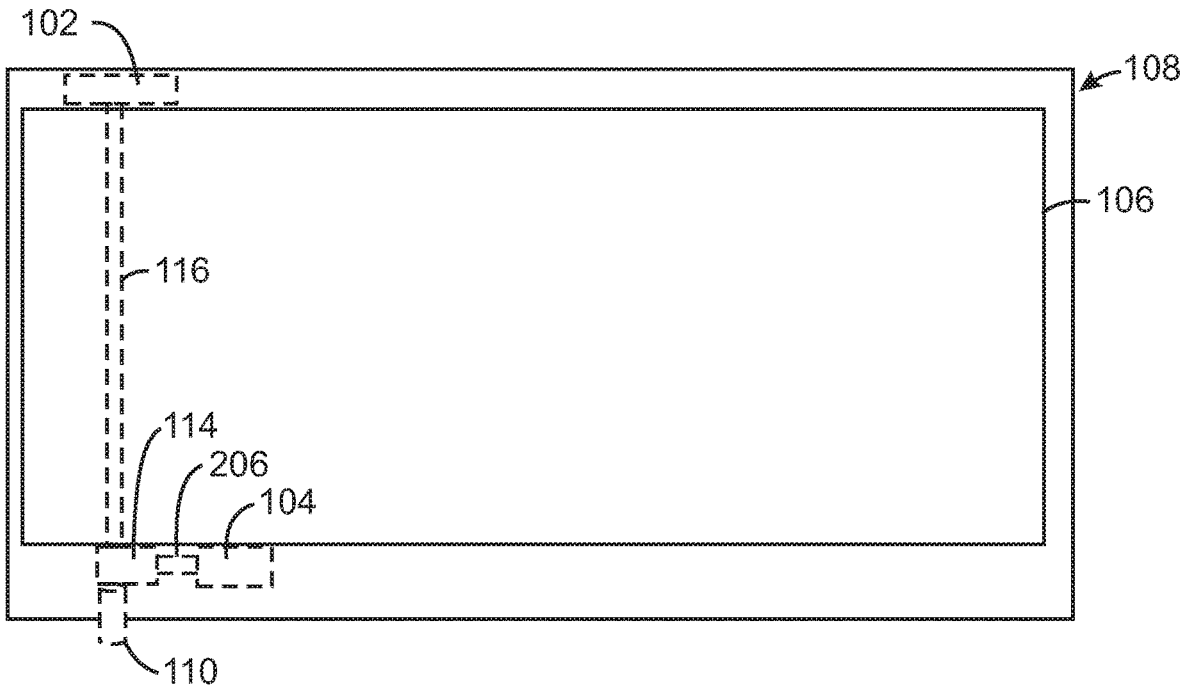
FIG. 3 is a drawing of an example of a hinge-up portion of a computing device showing an example of a single feed divided to feed separate antennas.

FIG. 3 is a drawing of an example of a hinge-up portion 108 of a computing device 300 showing an example of a single feed divided to feed separate antennas 102 and 104. Like numbered items are as described with respect to FIGS. 1 and 2.

Many combinations of frequencies may be used with the 2 antennas 102 and 104. For example, the first antenna 102 may be tuned to cover a frequency range of about 690 MHz to about 3000 MHz, while the second antenna 104 is tuned to cover a frequency range of about 3000 MHz to about 5850 MHz.

Accordingly, for a WWAN antenna application, such as in the LTE and LTE-U bands, the first antenna 102 may be tuned to cover frequency range of about 690 MHz to about 2690 MHz, while the second antenna 104 is tuned to cover frequency range of about 3400 MHz to about 5925 MHz. Other frequency combinations for WWAN applications may be used, such as having the first antenna 102 tuned to cover a frequency range of about 690 MHz to about 3800 MHz, while the second antenna 104 is due to cover frequency range of about 5150 MHz to about 5925 MHz.

The antennas may also be used for a WLAN antenna application, such as for a 2.4 gigahertz (GHz)/5 GHz dual band Wi-Fi connection. For example, the first antenna 102 may be tuned to cover a frequency range of about 2400 MHz to about 2500 MHz, while the second antenna 104 is tuned to cover a frequency range of about 5150 MHz to about 5850 MHz.

Accordingly, the use of the two antennas separated by the display panel 106 in the hinge-up portion 108 may be feasible due to the use of the FPC RF cable 116, which allows the signal to the first antenna 102 to be carried behind the display panel 106, even when the clearance in the case is very low, such as 0.3 mm in thickness. The use of the first antenna 102 for the low frequencies makes the losses in the FPC RF cable 116 more manageable.

Figure 4:
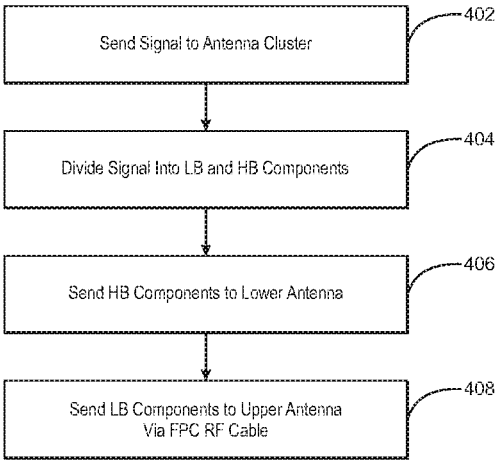
FIG. 4 is a process flow diagram of an example of a method for feeding separate antennas from a single feed.

FIG. 4 is a process flow diagram of an example of a method 400 for feeding separate antennas from a single feed. The method begins at block 402 when a signal is sent from a transceiver in an electronic device to an antenna cluster, for example, over coaxial cable threaded through a hinge connecting a lower portion of the laptop to an upper portion, or hinge-up portion, of the laptop.

At block 404, the signal is divided into lower band components, such as the LB, MB, and HB bands, and higher band components, such as the UHB and LAA/LTE-U bands. As described herein, this may be performed by a combination of bandpass filters, and impedance matching circuit, or combination thereof.

At block 406, the higher band components may be sent to the lower antenna, for example, below the display in the upper portion. This may be performed over a coaxial cable or an FPC RF cable. As the distance to the lower antenna is relatively short, such as one or two centimeters (cm), losses in an FPC RF cable may be acceptable for the higher band components.

At block 408, the lower band components may be sent to the upper antenna, for example, above the display in the upper portion. This may be performed over an FPC RF cable. The losses in the FPC RF cable for the lower band components may be acceptable, even though the distance from the signal divider circuitry to the upper antenna may be 20 cm or more.

Figure 5:
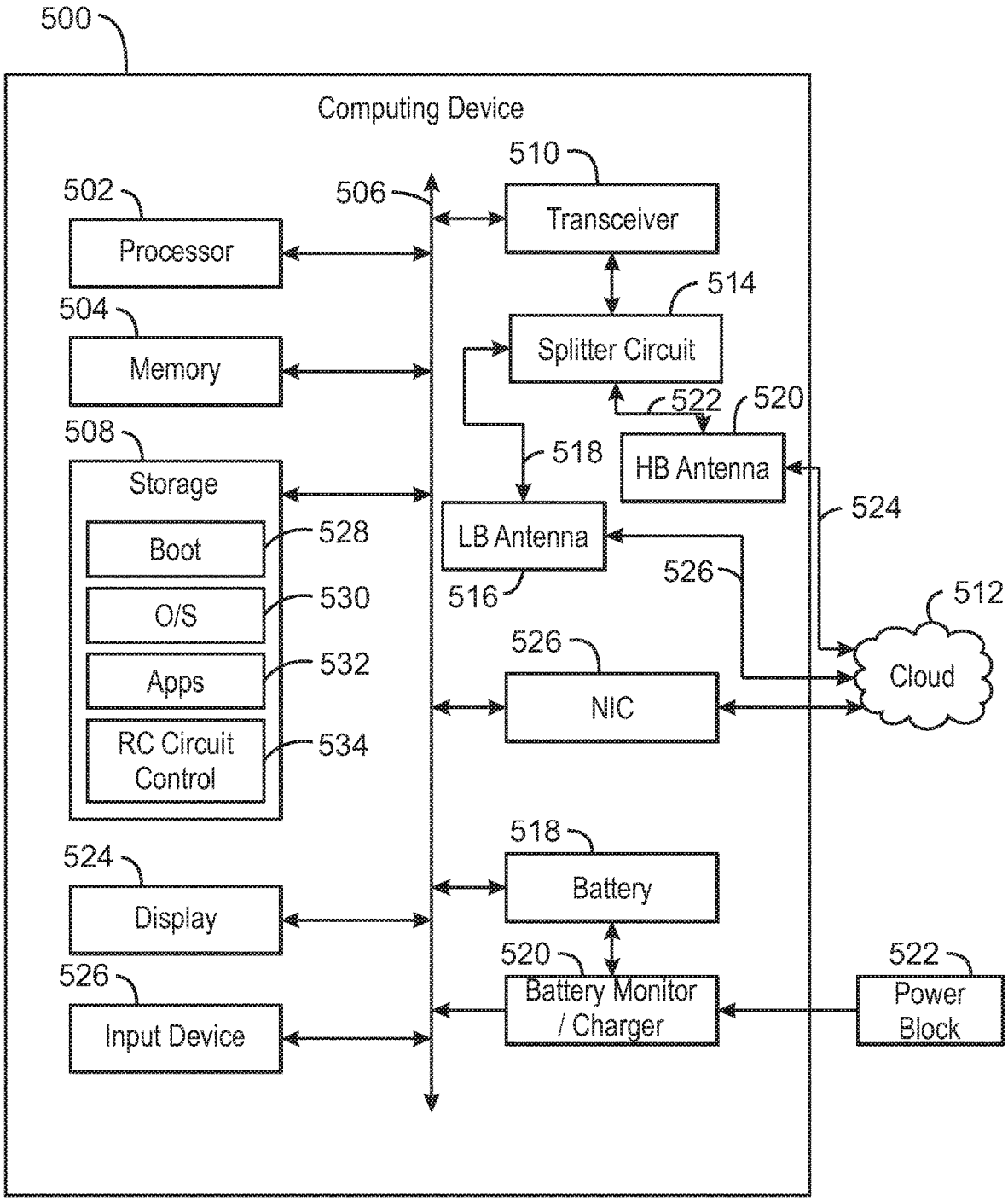
FIG. 5 is a block diagram of an example of components that may be present in a computing device for feeding separate antennas from a single feed.

FIG. 5 is a block diagram of an example of components that may be present in a computing device 500 for feeding separate antennas from a single feed. The computing device 500 may be a laptop computer, a tablet computer, a smart phone, or any number of other devices. The computing device 500 may include a processor 502, which may be a microprocessor, a single core processor, a multi-core processor, a multithreaded processor, an ultra-low voltage processor, an embedded processor, or any other type of processor. The processor 502 may be a part of a system-on-a-chip (SoC) in which the processor 502 and other components are formed into a single integrated circuit or on a single circuit board.

The processor 502 may communicate with a system memory 504 over a bus 506. Any number of memory devices may be used to provide for a given amount of system memory, including random access memory (RAM), static random access memory (SRAM), dynamic RAM (DRAM), and the like.

A mass storage 508 may also be coupled to the processor 502 via the bus 506. The mass storage 508 may be included to provide for persistent storage of information and data. The mass storage 508 may be implemented via a solid-state drive (SSD). Other devices that may be used for the mass storage 508 include read only memory (ROM), flash memory, micro hard drives, hard drives, and the like.

The components may communicate over the bus 506. The bus 506 may include any number of technologies, including industry standard architecture (ISA), extended ISA (EISA), peripheral component interconnect (PCI), peripheral component interconnect extended (PCIx), PCI express (PCIe), or any number of other technologies. The bus 506 may be a proprietary bus, for example, used in a SoC based system, such as in a smart phone, tablet computer, and the like. Other bus systems may be included, such as point-to-point interfaces and a power bus, among others.

The bus 506 may couple the processor 502 to a transceiver 510, or radio module, for communications with a cloud 512, such as a local network, a wide area network or the Internet. The transceiver 510 may use any number of frequencies and protocols, such as those described with respect to Table 1. The frequencies and protocols may include, for example, 2.4 GHz transmissions under the IEEE 802.15.4 standard, using the Bluetooth® low energy (BLE) standard, as defined by the Bluetooth® Special Interest Group. The frequencies and protocols may also include WLAN bands used to implement Wi-Fi™ communications in accordance with the Institute of Electrical and Electronics Engineers (IEEE) 802.11 standard. In addition, wireless wide area communications, for example, according to an LTE, 3G, or other cellular or wireless wide area protocol, can occur via a WWAN unit.

The transceiver 510 may include any number of RF transceiver ICs, such as Single-/Dual-Band 802.11a/b/g World-Band Transceiver ICs selected from the MAX2828/MAX2829 series available from Maxim Integrated of San Jose, Calif. Another example includes LTE dual-band front-end modules, such as the SKY68000-31, among others, available from Skyworks solutions of Woburn, Mass. Any number of other transceiver modules and chips known in the art may be used.

The signal from the transceiver 510 may be sent to a splitter circuit 514, for example, via coaxial cable as described herein. The splitter circuit 514 may include a combination of bandpass filters, and impedance matching circuit, or a combination thereof, as described herein.

The low frequency signals may be sent to a low band antenna 516, for example, over an FPC RF cable 518. As described herein the low band antenna may be placed above a display panel. The high-frequency signals may be sent to a high band antenna 520, for example, over a coaxial cable 522, or over a short segment of FPC RF cable.

The computing device 500 may then communicate with the cloud 512 using high-frequency signals 524 from the high band antenna 520 or low frequency signals 526 from the low band antenna 516. The computing device 500 is not limited to one set of antennas, but may include two or even three sets of antennas, depending on the frequency bands desired.

The computing device 500 may also include a network interface controller (NIC) 526 to provide a wired communication link to the cloud 512. The wired communication link may provide an Ethernet protocol connection, or may provide a wired communication link that is based on other types of network and interface protocols.

A battery 518 may power the computing device 500, although the computing device 500 may use a power supply that is directly coupled to an electric power grid. The battery 518 may be a lithium ion battery, a metal-air battery, or nickel cadmium battery, among others. A battery monitor/charger 520 may be included in the computing device 500 to charge the battery 518, monitor the charging of the battery 516, and monitor the status of the charge on the battery 516.

A power block 522 may be coupled with the battery monitor/charger 520 to charge the battery 518. In some examples, the power block 522 may be replaced with a wireless power receiver to provide the power wirelessly, for example, through a loop antenna in the computing device 500.

The bus 506 may couple the processor 502 to a display device 524. The display device 524 may be built into the computing device 500, such as a display panel in a hinge-up portion of laptop computer, or a display in a tablet computer or a smart phone. In other examples, the display device 524 may be an external device coupled to the computing device 500 through an interface.

An input device 526 may be coupled to the processor 502 through the bus 506. The input device 526 may be a touchscreen panel associated with the display device 524, a keyboard built into the computing device 500, a touchpad built into the computing device 500, an external pointing device, such as a keyboard or a mouse connected to the computing device 500, or any combinations thereof.

The mass storage 508 may include code modules to implement functionality. A booting module 528 may include start up code to boot the processor 502. An operating system 530 may be included to provide an interface between the user and the computing device 500, and to provide basic operations within the computing device 500. Applications 532 may be included to provide functionality, such as communication applications, word processing applications, and the like.

An RC-circuit control module 534 may be used to control the radio communications through the transceiver 510. The RC-circuit control module 534 may be configured to monitor crosstalk and interference to control the communications.

While the present techniques may be susceptible to various modifications and alternative forms, the examples discussed above have been shown only by way of example. It is to be understood that the technique is not intended to be limited to the particular examples disclosed herein. Indeed, the present techniques include all alternatives, modifications, and equivalents falling within the scope of the present techniques.

What is claimed:

1. An antenna structure for a laptop computer, comprising:

a lower frequency first antenna disposed above a display panel in a hinge-up portion of the laptop computer;

a higher frequency second antenna disposed below the display panel; and a signal divider circuit to receive first and second signals from a radio module, wherein the signal divider circuit is to send the first signal in a first frequency range to the first antenna over a flat printed circuit radio frequency (FPC RF) cable, and the second signal in a second frequency range to the second antenna, wherein the first frequency range is lower than the second frequency range, and a signal loss through the FPC RF cable is lower in the first frequency range than in the second frequency range.

2. The antenna structure of claim 1, wherein:

the first frequency range is less than 3000 megahertz (MHz); and the second frequency range is greater than 3000 MHz.

3. The antenna structure of claim 1, wherein:

the first frequency range is less than 2690 megahertz (MHz); and the second frequency range is greater than 3400 MHz.

4. The antenna structure of claim 1, wherein:

the first frequency range is less than 3800 megahertz (MHz); and the second frequency range is greater than 5100 MHz.

5. The antenna structure of claim 1, wherein the signal divider circuit comprises an impedance matching circuit.

6. The antenna structure of claim 1, wherein the signal divider circuit comprises a low bandpass filter and a high bandpass filter.

7. A method comprising:

receiving, at a signal divider circuit, a first signal and a second signal from a radio module;

dividing, by the signal divider circuit, the first signal and the second signal into a first frequency band and a second frequency band that is greater than the first frequency band;

sending, by the signal divider circuit, the first signal in the first frequency band to a lower frequency first antenna over a flat printed circuit radio frequency (FPC RF) cable, wherein the first antenna is above a display panel of a laptop computer; and sending, by the signal divider circuit, the second signal in the second frequency band to a higher frequency second antenna, wherein a signal loss through the FPC RF cable is lower in the first frequency band than in the second frequency band, and wherein the second antenna is below the display panel of the laptop computer.

8. The method of claim 7, comprising using a low bandpass filter in the signal divider circuit to send the first signal to the first antenna.

9. The method of claim 8, comprising using a high bandpass filter in the signal divider circuit to send the second signal to the second antenna.

10. The method of claim 7, comprising sending the second signal in the second frequency band to the second antenna over a coaxial cable.

11. The method of claim 7, comprising sending the first signal and the second signal from the radio module in a lower case of the laptop computer to the signal divider circuit in an upper case of the laptop computer over a coaxial cable threaded through a hinge of the laptop computer.

12. A laptop computer comprising:

a display panel; and an antenna structure for communications, the antenna structure comprising:

a lower frequency first antenna mounted inside an upper case of the laptop computer above the display panel;

a higher frequency second antenna mounted inside the upper case below the display panel;

a signal divider circuit mounted in the upper case below the display panel;

a flat printed circuit radio frequency (FPC RF) cable connecting the signal divider circuit to the first antenna;

a cable connecting the signal divider circuit to the second antenna; and a coaxial cable connecting the signal divider circuit to a radio module in a lower case of the laptop computer, wherein the signal divider circuit is to send a first signal in a first frequency range from the radio module to the first antenna over the FPC RF cable, and a second signal in a second frequency range to the second antenna, and wherein the first frequency range is lower than the second frequency range, and a signal loss through the FPC RF cable is lower in the first frequency range than in the second frequency range.

13. The laptop computer of claim 12, wherein the first frequency range is between 699 MHz and 2690 MHz, and the second frequency range is between 3400 MHz and 5925 MHz.

14. The laptop computer of claim 12, wherein the first frequency range is between 2400 MHz and 2500 MHz, and the second frequency range is between 5150 MHz and 5850 MHz.

15. The laptop computer of claim 12, wherein the cable comprises a coaxial cable.

16. The antenna structure of claim 1, wherein the FPC RF cable is to fit in a gap of less than 0.3 millimeters in the hinge-up portion between a cover of the laptop computer and the display panel.

17. The antenna structure of claim 1, wherein the FPC RF cable has a length of greater than 200 millimeters.

18. The antenna structure of claim 1, wherein the signal divider circuit is to send the second signal over a coaxial cable to the second antenna.

19. The method of claim 11, wherein the FPC RF cable fits in a gap of less than 0.3 millimeters, the gap being in the upper case and between a cover of the laptop computer and the display panel.

20. The laptop computer of claim 12, further comprising:

a cover, where a gap of less than 0.3 millimeters is between the cover and the display panel in the upper case, and wherein the FPC RF cable fits in the gap of less than 0.3 millimeters.

* * * * *